United States Patent [19]

DeCaro

[11] 3,983,513

[45] Sept. 28, 1976

[54] INCANDESCENT LAMP HAVING A HALOGEN-CONTAINING ATMOSPHERE AND AN INTEGRAL REFLECTOR OF NON-REACTIVE SPECULAR METAL

[75] Inventor: Aristide R. DeCaro, Edison, N.J.

[73] Assignee: Westinghouse Electric Corporation, Pittsburgh, Pa.

[22] Filed: Oct. 18, 1973

[21] Appl. No.: 407,727

[52] U.S. Cl. ..... 313/113; 313/222

[51] Int. Cl.[2] ..... H01K 1/32

[58] Field of Search ..... 313/222, 113, 114, 115

[56] References Cited

UNITED STATES PATENTS

| | | | |
|---|---|---|---|
| 2,785,327 | 3/1957 | Anderson | 313/113 |
| 2,870,362 | 1/1959 | Arnold et al. | 313/113 |
| 3,022,436 | 2/1962 | Cooper, Jr. | 313/222 |
| 3,022,437 | 2/1962 | Cooper, Jr. | 313/222 |
| 3,022,438 | 2/1962 | Cooper, Jr. | 313/222 |
| 3,022,439 | 2/1962 | Cooper, Jr. | 313/222 |
| 3,277,330 | 10/1966 | Cooper, Jr. | 313/222 |
| 3,445,662 | 5/1969 | Langley | 219/354 |
| 3,536,946 | 10/1970 | Kopelman et al. | 313/222 |

FOREIGN PATENTS OR APPLICATIONS

| | | | |
|---|---|---|---|
| 1,026,445 | 4/1966 | United Kingdom | 313/113 |

*Primary Examiner*—John Kominski

*Attorney, Agent, or Firm*—D. S. Buleza

[57] ABSTRACT

An electric lamp having a sealed-beam or single-ended domed type envelope that contains a tungsten filament and a halogen additive is provided with a specular coating of gold, palladium, platinum, or rhodium on a selected portion of its inner surface. The metal coating serves as a non-reactive interior reflector which does not getter the halogen additive or contaminate the lamp atmosphere and thus optically controls the light output of the lamp without interfering with the halogen-tungsten regenerative cycle. In an alternative embodiment, the outer surface of the envelope is properly contoured (to provide a parabolic surface, for example) and then coated with a thin layer of aluminum, silver, nickel or chromium which serves as an exterior reflector. The regenerative tungsten-halogen cycle is thus achieved in a reflector type lamp without the separate halogen lamp component heretofore required in such lamps.

14 Claims, 4 Drawing Figures

INCANDESCENT LAMP HAVING A HALOGEN-CONTAINING ATMOSPHERE AND AN INTEGRAL REFLECTOR OF NON-REACTIVE SPECULAR METAL

BACKGROUND OF THE INVENTION

1. Field of the Invention

This invention relates to electric lamps and has particular reference to an improved halogen incandescent lamp for general lighting and vehicular lighting purposes.

2. Description of the Prior Art

Incandescent lamps that contain a tungsten filament and a halogen atmosphere which coact during lamp operation to provide a regenerative cycle that returns vaporized tungsten back to the filament are well known in the art. An iodine-dosed lamp of this type is described in U.S. Pat. No. 2,883,571 issued to Fridrich et al. An incandescent projection lamp having an envelope that is composed of borosilicate glass and contains a halogen additive is disclosed in U.S. Pat. No. 3,648,094 to DeCaro et al. and a bipost halogen lamp having a specially designed filament mount structure is disclosed in U.S. Pat. No. 3,664,776 issued Feb. 22, 1972 to A. R. DeCaro, the author of the present invention. A halogen type incandescent projection lamp having a tubular quartz envelope that is provided with an exterior diffuse reflective coating of sintered layers of admixed phosphoric acid, silicic acid and ammonium bifluoride is described in U.S. Pat. No. 3,536,946 to Kopelman et al.

A sealed-beam type electric lamp that contains a compact tubular halogen lamp which serves as the light source is disclosed in U.S. Pat. No. 3,364,378 issued Jan. 16, 1968 to E. M. Beesley. An infrared heater device consisting of an iodine-filled incandescent lamp that is mounted in a reflector which is provided with a composite coating composed of a precious metal (such as gold, palladium, platinum or rhodium) and a barrier layer of a refractory oxide (such as cerium oxide, aluminum oxide, etc.) is disclosed in U.S. Pat. No. 3,445,662 issued May 20, 1969 to R. C. Langley.

SUMMARY OF THE INVENTION

While the prior art halogen-incandescent lamps were satisfactory with regard to life expectancy and lumen maintenance they were expensive to manufacture and were rather inefficient in that they employed a diffuse reflective coating or a separate enclosure such as a sealed beam envelope having a metallized reflector coating. It would thus be very desirable and advantageous to provide a reflector type incandescent lamp that could utilize the regenerative principle provided by a halogen atmosphere and which would also concentrate the light rays into a concentrated beam in a more efficient manner without the use of a separate outer envelope or bulb.

The foregoing objectives and other advantages are achieved in accordance with the present invention by utilizing a specular coating of a selected metal on either the inner or outer surface of the envelope that contains the tungsten filament and the halogen atmosphere. The metallized envelope thus serves both as an hermetically sealed enclosure for the halogen gas and tungsten filament and as an integral reflector which efficiently collects the generated light and beams it in the desired direction.

In one embodiment the envelope is of the sealed-beam type and in another embodiment the envelope is of the single-ended variety having a bulbous portion that is provided with the specular metal coating and serves as the reflector. The inner reflector coating consists essentially of a thin layer of a metal such as gold, palladium, platinum or rhodium that does not chemically react with or getter the halogen atmosphere. When the specular metal coating is applied to the exterior surface of the bulb it is composed of a metal such as silver, nickel, chromium, or aluminum which will withstand the elevated temperatures without oxidizing or otherwise deteriorating during the rated life of lamp.

BRIEF DESCRIPTION OF THE DRAWING

A better understanding of the invention will be obtained by referring to the exemplary embodiments shown in the accompanying drawing, wherein.

DESCRIPTION OF THE PREFERRED EMBODIMENTS

Figure 1:
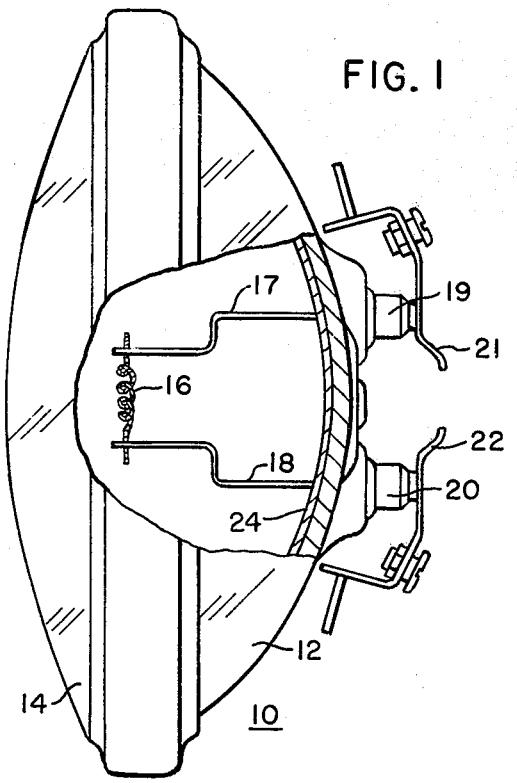
FIG. 1 is a side elevational view of a sealed-beam halogen lamp embodying the present invention, a portion of the lamp envelope being omitted for illustrative purposes.

The embodiment shown in FIG. 1 comprises a sealed-beam lamp 10 having the usual concave member 12 of molded glass that is hermetically joined at its periphery to a glass lens member 14 and thus provides a sealed light-transmitting enclosure for a tungsten filament 16. The lamp 10 which is illustrated is a 100 watt 12 volt PAR36 type lamp with a concave glass member 12 that is substantially parabolic in configuration and has a coiled-coil type filament 16 which is suspended at or near the focal point of the parabolic surface of member 12. The filament 16 is supported in this position by a pair of lead-in conductors such as lead wires 17 and 18 that are brazed or otherwise joined to metal ferrules 19 and 20 that are sealed into the back of the glass member 12. The ferrules are provided with metal terminals 21 and 22 which facilitate connection of the lamp to the power supply of the car.

The sealed-beam envelope formed by the reflector and lens components 12 and 14 is filled with a suitable inert gas, such as nitrogen, that is dosed with a preselected amount of a halogen gas (such as bromine or iodine) or a thermally-decomposable compound that provides a halogen additive or atmosphere within the operating lamp. As a specific example, the lamp is filled with 99.9% nitrogen and about 0.1% methylene bromide at 600 mm. pressure. Both the fill gas and the fill gas pressure, as well as the dosage of the halogen or halogen-providing additive, can be varied from the aforesaid values as will be apparent to those skilled in the art. Concave member 12 and lens 14 are composed of a suitable "hard" glass such as borosilicate glass.

In the FIG. 1 embodiment the integral reflector component of the lamp 10 consists essentially of a thin specular layer 24 of a metal that does not chemically react with or getter the halogen at the elevated temperatures which prevail during lamp operation and also does not contaminate the lamp 10 . . . thus serving as an efficient specular reflector coating that remains intact and operative throughout the rated life of the lamp. Thin specular coatings of metals selected from the group consisting of gold, platinum, palladium and rhodium have all of the aforesaid properties. The specular coating 24 is desirably thick enough to reflect infrared energy as well as light rays and thus helps to provide a sufficiently high bulb wall temperature to maintain the tungsten-halogen cycle.

Of course, the portions of the lead wires 17 and 18 that are exposed to the halogen atmosphere are composed of a suitable metal, such as tungsten or molybdenum, that will not be corroded or attacked by the halogen. In order to prevent the halogen additive from attacking the ferrules 19 and 20 the latter are fabricated from copper-nickel alloy and their inner surfaces are plated with a layer of platinum. To avoid contaminating the lamp, the platinum coated ferrules were baked at 400°C. For 30 minutes, the mounted filament 16 was flashed at 12, 18 and 24 volts in a hydrogen atmosphere and the envelope was evacuated and flushed with nitrogen prior filling it with the halogen dosed nitrogen fill gas and sealing it off.

Figure 2:
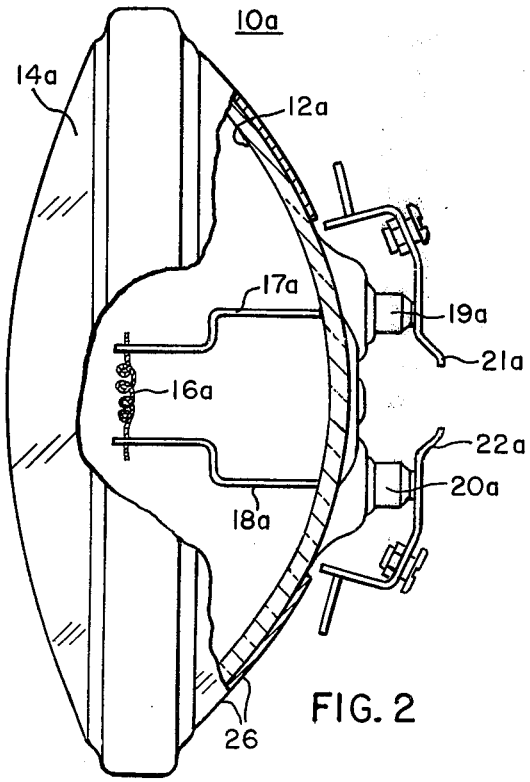
FIG. 2 is a similar view of another sealed-beam halogen lamp utilizing an exterior reflector coating.

An alternative PAR36 type sealed-beam lamp 10a is shown in FIG. 2. The structural features of this lamp are identical with those previously described in connection with the FIG. 1 embodiment except that the integral reflector component consists of a specular layer 26 of a selected metal that is coated onto the outer surface of the parabolic glass member 12*a*. Since the reflector coating 26 in this embodiment is exposed to air, it is composed of a suitable non-oxidizing metal such as silver, aluminum, nickel, or chromium that will efficiently reflect impinging light rays back through the wall of glass member 12a and out of the lens 14a. The outer surface of the glass member 12a is deliberately contoured so that it defines a substantially parabolic surface and the reflector coating 26 is disposed in such relationship with the filament 16a that an efficient and precise light-reflecting optical system is provided.

Tests have shown that lamps fabricated in the forementioned manner and having an external reflector of aluminum burned for 78 hours (more than three times the 25 hour rated life for a conventional lamp) and maintained an average color temperature of 3210° K on the cold portion of the filament and an average color temperature of 3360° K on the hot portion of the filament, even after the lamps had burned for 50 hours.

While a single filament is employed in the sealed-beam lamps 10 and 10*a* shown in FIGS. 1 and 2, respectively, it will be apparent to those skilled in the art that two or more filaments that are properly positioned relative to the focal point of the reflector surface defined by the specular coating can be utilized to provide a vehicular lamp having two or more lighting levels and two or more beam patterns.

Figure 3:
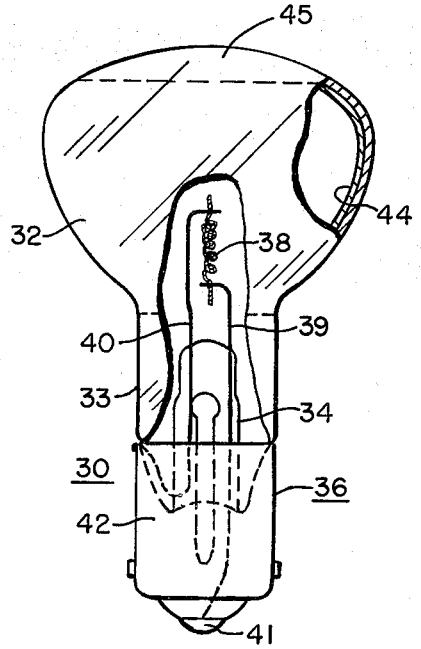
FIG. 3 is an elevational view of a single-ended type incandescent-halogen reflector lamp having an interior specular metal coating; and, FIG. 4 is a similar view of another reflector lamp embodiment with the same type of envelope having an exterior reflective metal coating.

A 40 watt 120 volt R12 type halogen-incandescent lamp embodying the invention is shown in FIG. 3. The lamp 30 is of the conventional single-ended variety and consists of a bulbous-shaped envelope 32 which has a tubular neck portion 33 that is sealed to the usual stem 34 and is fitted with a base member 36. The envelope 32 contains a coiled-coil tungsten filament 38 that is supported in axially-extending position by a pair of tungsten lead wires 39, 40 which are sealed through the stem 34. Lead wire 39 is connected to the end contact

41 of the base 36 and the other wire 40 is connected to the rim of the base shell 42, as shown. The envelope 32 contains a suitable inert fill gas, such as nitrogen, and a halogen additive such as bromine or iodine which can be initially introduced in the form of a thermally-decomposable compound (methylene bromide, for example. The lead wires 39, 40 are composed of tungsten or a similar metal that will not be attacked by the halogen atmosphere.

In accordance with the present invention, the curved side walls of the bulbous envelope 32 are internally coated with a thin specular layer 44 of a suitable non-reactive metal such as gold, platinum palladium, or rhodium. As will be noted, the internal reflective coating 44 is restricted to the curved side wall and neck portions of the envelope 32 so that the tubular neck 33 remains clear and the domed end of the envelope is also left uncoated and serves as a lens component 45 that transmits the reflected light rays. The configuration of the envelope 32 is such that the specular metal reflector coating 44 defines a substantially parabolic surface the focal point whereof is substantially coincident with the filament 38.

Figure 4:
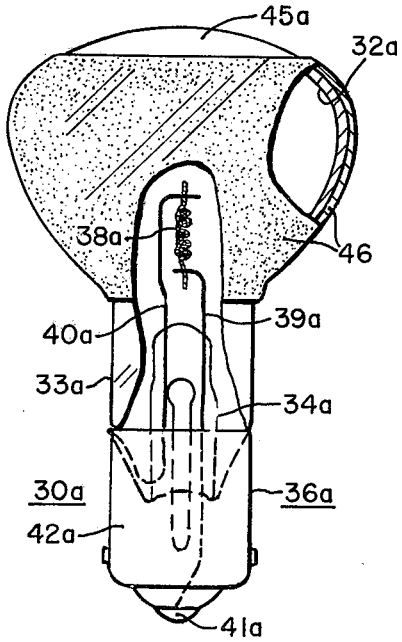

The alternative halogen-incandescent lamp embodiment 30a shown in FIG. 4 is identical with that shown in FIG. 3 except that the specular reflector coating 46 is disposed on the outer surface of the curved side walls of the envelope 32*a* and the coating is composed of a non-oxidizing metal such as aluminum, nickel, chromium or silver.

I claim:

1. A halogen-cycle reflector type electric incandescent lamp that has a predetermined rated life, said lamp comprising;

a sealed envelope of light-transmitting material that contains (*a*) an atmosphere which consists essentially of an inert fill gas and a halogen and (*b*) a filament which consists essentially of tungsten and is thus adapted, when energized, to coact with said halogen and establish a regenerative cycle within the lamp during operation thereof that returns vaporized tungsten to said filament, lead-in conductors extending into said envelope and electrically connected to said filament, the portions of said conductors that are exposed to said halogen being composed of a material that is substantially inert with respect to the halogen, and reflector means disposed on and integral with a selected portion of said envelope, said reflector means consisting essentially of a thin specular coating of a metal that withstands both the atmosphere and temperatures to which it is exposed when the lamp is energized and operated so that the specular metal coating thereby retains its light-reflective property and serves as an integral reflector throughout the rated life of the lamp.

2. The halogen-cycle reflector incandescent lamp of claim 1 wherein said specular metal coating is disposed on the inner surface of said envelope and consists essentially of a metal selected from the group consisting of gold, palladium, platinum and rhodium.

3. The halogen-cycle reflector incandescent lamp of claim 1 wherein said specular metal coating is disposed on the outer surface of said envelope and consists essentially of a metal selected from the group consisting of silver, aluminum, chromium and nickel.

4. The halogen-cycle reflector incandescent lamp of claim 1 wherein;

said envelope comprises a glass member of concave configuration that is hermetically sealed to a glass lens component and the lamp thus constitutes a sealed-beam lamp, and said specular metal coating is located on said concave glass member.

5. The sealed-beam halogen-cycle reflector lamp of claim 4 wherein;

said halogen is iodine or bromine, and the portions of said lead-in conductors within said envelope that are exposed to said halogen are composed of tungsten or molybdenum.

6. The sealed-beam halogen cycle reflector lamp of claim 4 wherein said specular metal coating is disposed on the inner surface of said concave glass member and consists essentially of a metal selected from a group consisting of gold, palladium, platinum and rhodium.

7. The sealed-beam halogen-cycle reflector lamp of claim 4 wherein;

the exterior surface of said concave glass member is of such configuration that it defines a substantially parabolic surface, and said specular metal coating is disposed on the exterior substanitally parabolic surface of said concave glass member and consists essentially of a metal selected from the group consisting of silver, aluminum, chromium and nickel.

8. The sealed-beam halogen-cycle reflector lamp of claim 7 wherein the tungsten filament is disposed in predetermined spatial relationship with the focal point of the substantially parabolic reflector that is defined by the exterior surface of said glass member and the specular metal coating thereon.

9. The halogen-cycle reflector incandescent lamp of claim 1 wherein;

said envelope is of domed bulbous configuration with a sealed neck portion that is fitted with a base member and the lamp is thus of the single-ended type, and said specular metal coating is disposed on the curved side wall portion of the bulbous envelope.

10. The single-ended halogen-cycle reflector incandescent lamp of claim 9 wherein said specular metal coating only extends over the said side wall portion of the envelope and the domed end wall and neck portion of the envelope are thus devoid of said specular metal coating and are light transmitting.

11. The single-ended halogen-cycle reflector incandescent lamp of claim 9 wherein said specular metal coating is disposed on the inner surface of the curved side wall portion of said bulbous envelope and consists essentially of a metal selected from the group consisting of gold, palladium, platinum and rhodium.

12. The single-ended halogen-cycle reflector lamp of claim 9 wherein said specular metal coating is disposed on the outer surface of the curved side wall portion of said bulbous envelope and consists essentially of a metal selected from the group consisting of silver, aluminum, chromium and nickel.

13. The halogen-cycle reflector incandescent lamp of claim 1 wherein;

said envelope is composed of glass, said halogen is iodine or bromine, and the portions of said lead-in conductors within said envelope that are exposed to the halogen are composed of tungsten or molybdenum.

14. The halogen-cycle reflector incandescent lamp of claim 1 wherein said specular metal coating reflects both infrared energy and light rays.

* * * * *